United States Patent [19]

Ozawa et al.

[11] Patent Number: 4,834,563

[45] Date of Patent: May 30, 1989

[54] THERMAL INK-TRANSFER PRINTER PROVIDED WITH JAM DETECTING DEVICE

[75] Inventors: Naohiro Ozawa, Yokohama; Toshihiko Gotoh, Tokyo; Junichi Shoji, Katsuta, all of Japan

[73] Assignee: Hitachi, Ltd., Tokyo, Japan

[21] Appl. No.: 47,216

[22] Filed: May 8, 1987

[30] Foreign Application Priority Data

May 14, 1986 [JP] Japan ..... 61-108584
Sep. 29, 1986 [JP] Japan ..... 61-228272

[51] Int. Cl.[4] ..... B41J 3/20

[52] U.S. Cl. ..... 400/120; 400/247; 400/703; 400/711

[58] Field of Search ..... 400/120, 234, 249, 618, 400/703, 707.1, 708, 225, 247, 711; 250/231 SE

[56] References Cited

U.S. PATENT DOCUMENTS 3,902,063 8/1973 Oelsch et al. ..... 250/231 SE
4,421,980 12/1983 Kuhne ..... 250/231 SE

FOREIGN PATENT DOCUMENTS 32990 2/1982 Japan ..... 400/247
204587 11/1984 Japan ..... 400/120
165281 8/1985 Japan ..... 400/120
184865 9/1985 Japan ..... 400/120

OTHER PUBLICATIONS

"Two Point Paper Path Condition Switch"; *IBM TDB;* J. H. Dodge et al.; vol. 22, No. 3, pp. 913–914, 8/1979.

*Primary Examiner*—David A. Wiecking
*Attorney, Agent, or Firm*—Antonelli, Terry & Wands

[57] ABSTRACT

A thermal ink-transfer printer is disclosed in which an ink donor sheet is wound on a supply reel. The ink donor sheet is drawn out from the supply reel and passes between a rotating drum and a thermal head and is then rolled round a winding reel. Printing paper is moved in a printing-paper transporting path formed between the rotating drum and guide means. The thermal head presses the ink donor sheet against the printing paper and heats the ink donor sheet to transfer the ink on the ink donor sheet to the printing paper. The ink donor sheet after completing the ink transfer is separated from the printing paper and rolled round the winding reel. The printing paper separated from the ink donor sheet is moved in the printing-paper transporting path. When the ink donor sheet during separation from the printing paper is erroneously drawn into a predetermined portion of the printing-paper transporting path, this erroneous operation of the ink donor sheet is detected by jam detecting means.

12 Claims, 11 Drawing Sheets

THERMAL INK-TRANSFER PRINTER PROVIDED WITH JAM DETECTING DEVICE

BACKGROUND OF THE INVENTION

The present invention relates to a thermal ink-transfer printer, in which an ink donor sheet is placed upon printing paper, and the ink attached to the ink donor sheet is transferred to the printing paper by supplying heat from a thermal head to the ink donor sheet.

Conventional printers, Xerographic apparatuses, and others are provided with a jam detecting device, to prevent a paper transporting path from being jammed with paper.

One of conventional jam detecting devices, as described in, for example, Japanese patent Publication (JP-B) No. 56-45787, includes a mechanical switch disposed in a printing-paper transporting path and operated each time a bent or curved portion of printing paper pushes the mechanical switch, and a counter for counting up operations of the mechanical switch, to judge whether or not the number of operations of the mechanical switch performed in a predetermined time exceeds a predetermined value, thereby checking whether or not the transporting path is jammed with the printing paper. Another conventional jam detecting device, as described in Japanese Patent Laid-open publication (JP-A) No. 60-35755, includes printing-paper detecting means provided at an appropriate position in a printing-paper transporting path, to judge that the transporting path is jammed with the printing paper, when the detecting means fails to detect the printing paper in a predetermine time.

In the above-mentioned jam detecting devices, when the printing-paper transporting path is blocked by the printing paper, or the printing paper is caught by something and thus is bent, the transporting path is judged to be jammed with the printing paper.

In a thermal ink-transfer printer, however, it is necessary not only to detect that the transporting path is jammed with the printing paper but also to detect if the transporting path is jammed with an ink donor sheet.

That is, in a thermal ink-transfer printer in which an ink donor sheet is placed on printing paper, and the ink on the ink donor sheet is transferred to the printing paper by supplying heat to the ink donor sheet, the ink donor sheet is put in close contact with the printing paper by a thermal head and a rotating drum. Accordingly, even after the ink transfer has been completed, the ink donor sheet is kept in close contact with the printing paper. When the separation of the ink donor sheet from the printing paper results in failure owing to static electricity or for other reasons, the ink donor sheet is drawn into a portion of a printing-paper transporting path, and thus there is a malfunction because the printing-paper transporting path is jammed with the ink donor sheet.

SUMMARY OF THE INVENTION

It is an object of the present invention to provide a thermal ink-transfer printer which can easily detect that an ink donor sheet after having transferred ink to printing paper is drawn into a portion of a printing-paper transporting path, to prevent the printing-paper transporting path from being jammed with the ink donor sheet.

In order to attain the above object, according to the present invention, there is provided a thermal ink-transfer printer which includes jam detecting means for generating a signal when an ink donor sheet having transferred ink to printing paper is drawn into a portion of a printing-paper transporting path.

Thus, the thermal ink-transfer printer according to the present invention can early detect that the ink donor sheet is drawn into a portion of the printing-paper transporting path, and can carry out appropriate processing such as the suspension of operation immediately after the above detection, thereby preventing the printing-paper transporting path from being jammed with the ink donor sheet

DESCRIPTION OF THE PREFERRED EMBODIMENT

Figure 1:
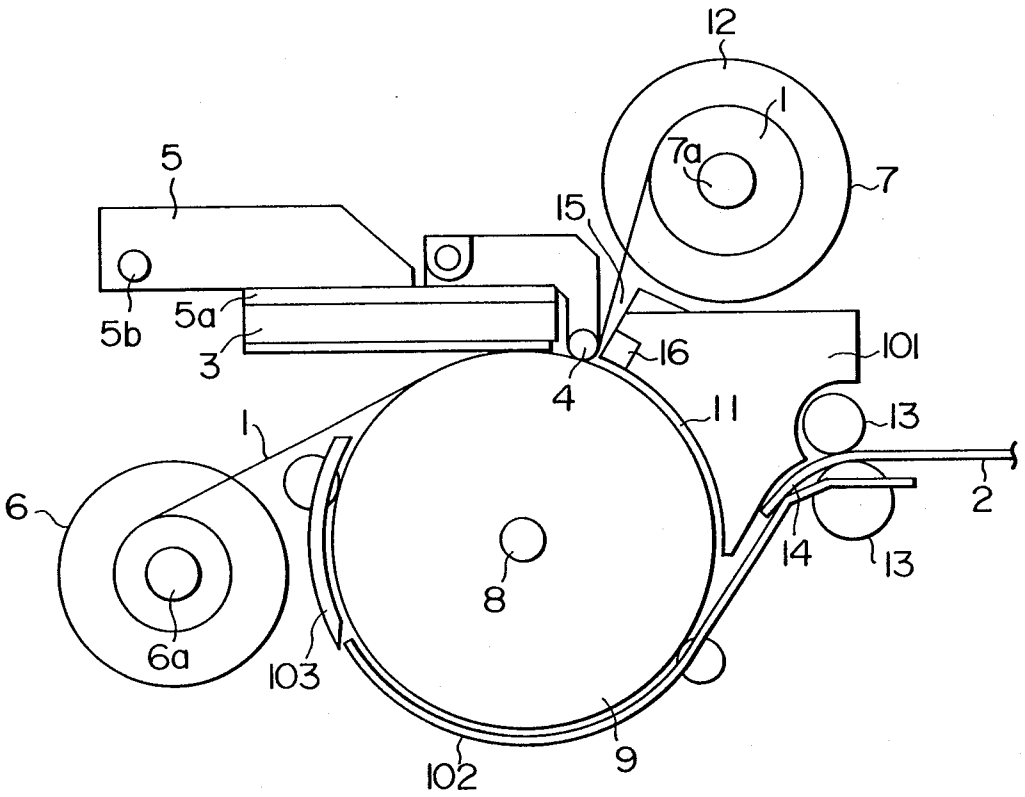
FIG. 1 is a side view showing a main part of an embodiment of a thermal ink-transfer printer according to the present invention.

FIG. 1 is a side view showing a main part of an embodiment of a thermal ink-transfer printer according to the present invention. Referring to FIG. 1, the present embodiment includes a supply reel 6 wound with an ink donor sheet 1, a winding reel (namely, a take-up reel) 7 for rolling the ink donor sheet 1 from the supply reel 6 round the reel 7, a rotating drum 9 for carrying printing paper 2, a thermal head 3, a separation member 4, and guide means 10. The thermal head 3 is mounted on a head base 5*a* which is attached to a head arm 5, and the head arm 5 is supported rotatably by an arm shaft 5*b*.

When the head arm 5 is rotated anticlockwise the ink donor sheet 1 can be changed by demounting the supply reel 6 and the winding reel 7 from a supply shaft 6*a* and a winding shaft 7*a*, respectively. The guide means 10 is separated into a plurality of guide members 101, 102 and 103, each of which has substantially the same radius of curvature as the rotating drum 9, and a path 11 for transporting the printing paper 2 is formed between the cylindrical surface of the rotating drum 9 and each of the guide members 101, 102 and 103. As the head arm 5 is rotated, the thermal head 3 is pressed against the ink donor sheet 1 at a region between the guide members 101 and 103 where a portion of the thermal head is inserted.

The printing paper 2 is supplied from between two paper feeding rollers 13, and is led to the transporting path 11 through a paper inlet 14.

Further, jam detecting means 16 is provided at an end portion of the guide member 101 on the thermal head side thereof.

The ink donor sheet 1, which is coated with ink made of sublimable dyes or pigment-containing wax is drawn out from the supply reel 6, passes between the thermal head 3 and the rotating drum 9, and is rolled round the winding reel 7.

The drum 9 is rotatable round a main shaft 8, and is rotated together with the winding reel 7 with the aid of a power transmission mechanism (not show).

Further, the winding reel 7 is mounted with driving-force stabilizing means such as a sliding clutch (namely, a friction clutch) 12, and is linked with the power transmission mechanism through the sliding clutch 12

Now, explanation will be made of the operation of the present embodiment.

The ink donor sheet 1 is drawn out from the supply reel 6, and then passes between the thermal head 3 and the drum 9. At this time, the ink donor sheet 1 is laid on the printing paper 2 which is supplied from the paper inlet 14 and carried in the transporting path 11, and the ink donor sheet 1 and the printing paper 2 pass between the thermal head 3 and the drum 9 as one body. Further, the ink donor sheet 1 is heated by the thermal head 3 in accordance with a pattern to be printed, and thus the ink on the ink donor 1 is transferred to the printing paper 2. Thereafter, the ink donor sheet 1 and the printing paper 2 are separated from each other by the separation member 4. The ink donor sheet 1 having been separated from the printing paper 2 passes a winding path 15, to be rolled round the winding reel 7. The printing paper 2 is led to that portion of the transporting path 11 which is formed between the drum 9 and the guide member 101. When the ink donor sheet 1 does not pass the winding path 15 but is drawn into the above portion of the transporting path 11, the jam detecting means 16 detects such a state, and generates a signal which indicates that the transporting path 11 is ammed with the ink donor sheet 1.

Figure 2:
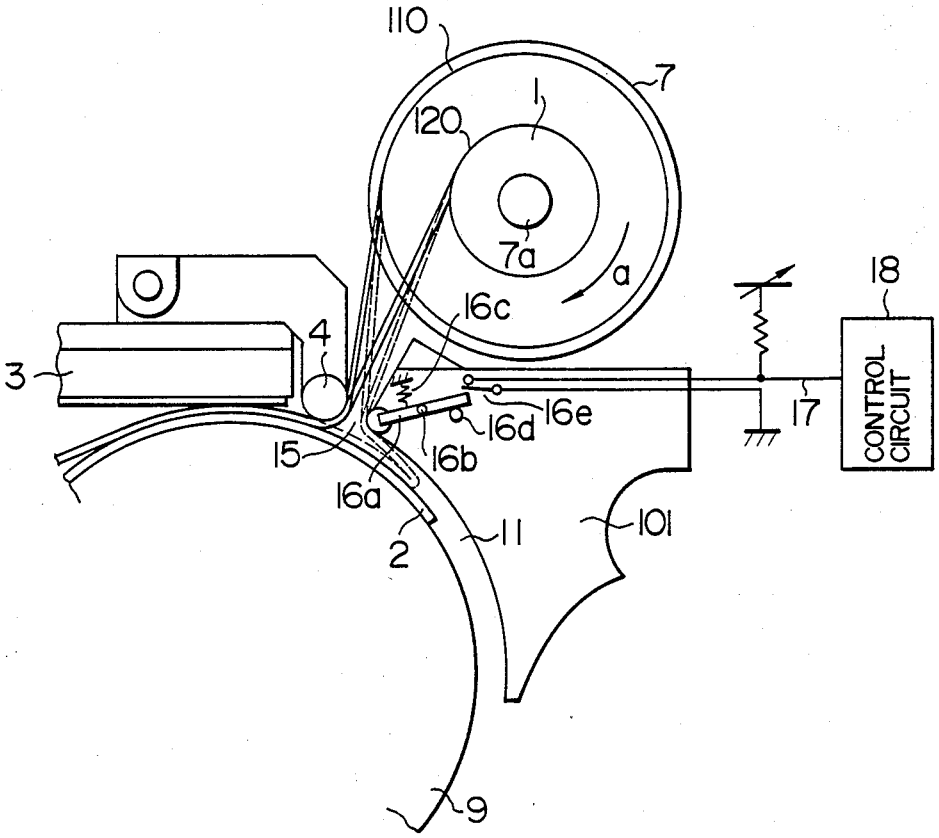
FIG. 2 is a side view showing an example of the jam detecting means of FIG. 1.

FIG. 2 is an enlarged view showing an example of the jam detecting means 16 and its neighborhood.

Referring to FIG. 2, the jam detecting means 16 is made up of a detection member 16*a*, a detection shaft 16*b*, a tension spring 16*c*, a stop member 16*d*, a switch 16*e*, and others, and is disposed so that the tip of the detection member 16*a* slightly enters the winding path 15. Further, the detection member 16*a* is mounted for pivotal movement about the axis of detection shaft 16*b*, and one side of the detection member 16*a* is pulled up by the tension spring 16*c*. The rotation of the other end of the member 16*a* round the detection shaft 16*b* is limited by the stop member 16*d*. The switch 16*e* is disposed so that the other end of the member 16*a* exists between the stop member 16*d* and the switch 16*e*, and a detection output 17 from the switch 16*e* is applied to a control circuit 18.

Next, the operation of the jam detecting means will be explained with reference to FIGS. 1 and 2.

When the printing paper 2 is inserted between a pair of paper feeding rollers 13 and the rollers 13 are rotated, the printing paper 2 passes through the paper inlet 14 and is then transported by the cylindrical surface of the rotating drum 9 along the guide member 102 and 103. After having passed between the drum 9 and the guide member 103, the printing paper 2 is pressed against the drum by the thermal head 3 and the separation member 4. The ink donor sheet 1 drawn out from the supply reel 6 is also pressed against the drum 9 by the thermal head 3 and the separation member 4. Thus, the printing paper 2 passes under the thermal head 3 in a state that the printing paper 2 is sandwiched between the drum 9 and the ink donor sheet 1. At this time, electric power is supplied to the thermal head 3, to transfer the ink from the ink donor sheet 1 to the printing paper 2, thereby performing a printing operation. When the ink donor sheet 1 and the printing paper 2 which are kept in close contact with each other, reach the separation member 4, the ink donor sheet 1 is pulled up to the winding reel 7 by the driving force of the winding shaft 7*a*, and the printing paper 2 moves in the transporting path 11 along the inner wall of the guide member 101. Thus, the ink donor sheet 1 and the printing paper 2 can be separated from each other.

In a case where the ink donor sheet 1 adheres strongly to the printing paper 2 owing to the overheating caused by the thermal head 3 or static electricity, and moreover the driving force of the winding shaft 7*a* in a direction a as indicated with an arrow is insufficient, the ink donor sheet 1 is not separated from the printing paper 2 but is drawn into that portion of the printing-paper transporting path 11 which is formed between the drum 9 and the guide member 101, as indicated by broken lines in FIG. 2. At this time, the ink donor sheet 1 is moved in a direction in which the printing paper 2 is transported, and comes in contact with the wall surface of the guide member 101 and the tip of the detection member 16*a*. That is, the detection member 16*a* turns round the detection shaft 16*b* while striving against the elastic force of the tension spring 16*c*, to push the movable member of the switch 16*e*, thereby turning on the switch 16*e*. The output signal 17 of the switch 16*e* at this time is received by the control circuit 18, and thus it is known that the printing-paper transporting path is jammed with the ink donor sheet 1.

The tip of the detection member 16*a* is disposed in the winding path 15 so as to exist in the vicinity of the entrance of that portion of the transporting path 11 which is formed between the drum 9 and the guide member 101. Hence, even when the number of turns of the ink donor sheet 1 o the winding reel 7 is maximum (as indicated by a circle 110) or minimum (as indicated by a circle 120), the ink donor sheet 1 does not come in contact with the detection member 16*a* nor cause any malfunction, provided that the winding operation of the winding reel 7 is normally performed.

Further, when the printing paper 2 is erroneously transported into the winding path 15, and a jam is caused, due to the printing paper 2 being thicker and having a larger rigidity, the leading end of the printing paper 2 pushes the detection member 16*a*, to turn the switch 16*e* on, and, the jam can be detected.

Further, in a case where the jam detecting means 16 is formed of a pressure sensitive switch as shown in FIG. 2, the abnormal transportation of the printing paper 2 can be detected, even when the printing paper 2 is formed of a transparent sheet such as OHP paper.

Figure 3:
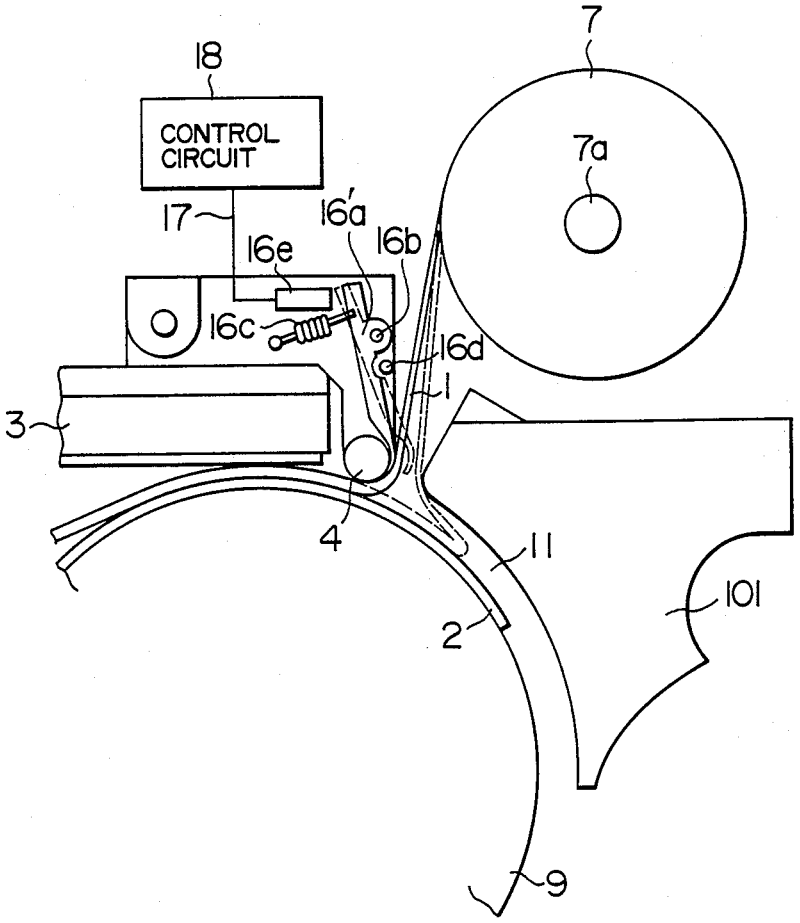
FIGS. 3 and 4 are side views showing further examples of the jam detecting means.

FIG. 3 shows another example of the jam detecting means 16. The present example is disposed at a position different from the position of the example of FIG. 2.

Referring to FIG. 3, a detection member 16*a'* rotatable round a shaft 16*b*, a tension spring 16*c* for rotating the detection member 16*a'* counterclockwise a stop member 16*d* for limiting the above rotation of the detection member 16*a'*, and a switch 16*e* for judging whether or not one end of the detection member 16*a'* is put in contact with a movable member of the switch 16*e*, are all disposed on the winding reel side of the separation member 4. The other end of the detection member 16*a'* is inserted between the ink donor sheet 1 and the separation member 4.

Now, the operation of the present example will be explained below.

In a case where the thermal head 3 is spaced apart from the rotating drum 9, one end of the detection member 16*a'* is put in contact with the movable member of the switch 16*e* by the elastic force of the tension spring 16*c*. The output signal 17 of the switch 16*e* for this case is applied, as an OFF-signal, to a control circuit 18.

When the thermal head 3 is rotated so as to be pressed against the rotating drum 9, the other end of the detection member 16*a'* is put in contact with the ink donor sheet 1, and thus one end of the detection member 16*a'* is spaced apart from the movable member of the switch 16*e* while striving against the elastic force of the tension spring 16*c*. Thus, the output signal 17 of the switch 16*e* is applied, as an ON signal, to the control circuit 18.

In a case where the ink donor sheet 1 is drawn into that portion of the transporting path 11 which is formed between the guide member 101 and the drum 9, however, the ink donor sheet 1 goes away from the separation member 4, and thus the detection member 16*a'* rotates round the shaft 16*b* anticlockwise. Accordingly, one end of the detection member 16*a'* pushes the movable member of the switch 16*e*, notwithstanding the thermal head 3 is pressed against the drum 9. That is, the switch 16*e* is turned on, and the OFF-signal is sent to the control circuit 18, to inform to a system control circuit that the transporting path 11 is jammed with the ink donor sheet 1.

Further, according to the present example, even when the ink donor sheet 1 is cut or wrinkles are created in the ink donor sheet 1, such accidents can be detected by the same operation as mentioned above. Further, according to the present example, the output signal 17 of the switch 16*e* is changed from the OFF-signal to the ON-signal, when the thermal head 3 is pressed against the drum 9. Thus, it can be detected by the output signal 17 whether or not the thermal head 3 has been pressed against the drum 9.

In the above, explanation has been made of jam detecting means including a mechanical switch. However, the jam detecting means may include optical means, instead of the mechanical switch.

Figure 4:
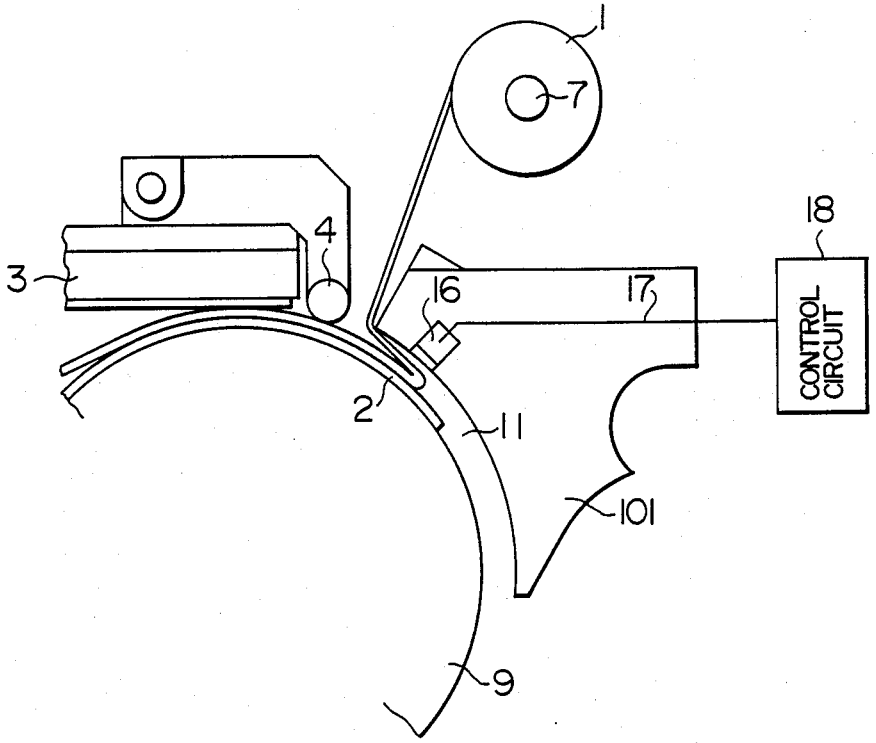

FIG. 4 is a side view showing a further example of the jam detecting means. Referring to FIG. 4, jam detecting means 16 including a photo-sensor such as a photo-coupler is fixed to the guide member 101 at a position along the printing-paper transporting path 11.

Figure 5:
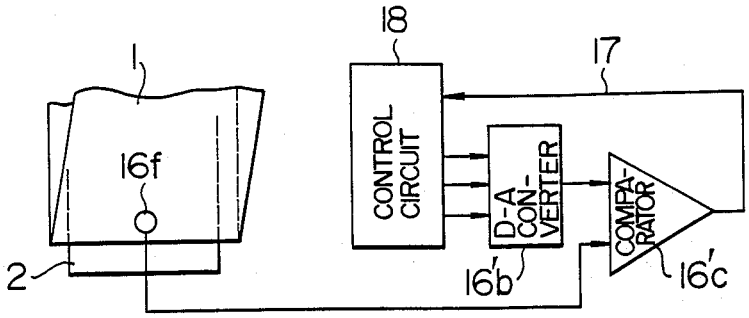
FIG. 5 is a circuit diagram showing the electrical connection between a photo-sensor and a detection circuit which make up the further example of FIG. 4.

FIG. 5 shows the circuit configuration of the example of FIG. 4. Referring to FIG. 5, a signal capable of taking a plurality of levels is sent from a control circuit 18 to a comparator 16*c'* through a D-A converter 16*b*. In a case where no body exists in that portion of the transporting path 11 which is formed between the drum 9 and the guide member 101, the output signal of a photo-sensor 16*f* takes a level corresponding to light reflected from the surface of the drum 9. In a case where only the printing paper 2 exists in the above portion of the transporting path 11, the output signal of the photo-sensor 16*f* takes a level corresponding to light reflected from the surface of the printing paper 2. Further, in a case where the ink donor sheet 1 is drawn into the above-mentioned portion of the transporting path 11, the output signal of the photo-sensor 16*f* takes a level corresponding to light which passes through the ink donor sheet 1, is reflected from the surface of the printing paper 2, and passes again through the ink donor sheet 1. Thus, the output signal of the photo-sensor 16*f* has different levels for these cases. A reference signal capable of taking each of these levels is sent from the control circuit 18 to one input terminal of the comparator 16*c'* through the D-A converter 16*b'*, and the output signal of the photo-sensor 16*f* is applied to the other input terminal of the comparator 16*c'* Thus, the output signal 17 of the comparator 16*c'* can inform the control circuit 18 of the output level of the photo-sensor 16*f*. That is, the present example can detect that the transporting path 11 is jammed with the ink donor sheet 1.

According to the present example, even when the ink donor sheet 1 is a polychromatic one containing yellow, cyan, magenta, black and others, a state that the ink donor sheet 1 is drawn into the above-mentioned portion of the transporting path 11, can be detected by increasing the number of levels of the reference signal. Since only a single photo-sensor is used, the present example can be readily disposed at a desired position, and moreover is inexpensive.

Further, in a case where the output signal 17 indicates that the photo-sensor 16*f* receives light reflected from the surface of the drum 9, at a time when a predetermined period has already elapsed after the supply of electric power to the thermal head 3 (that is, the beginning of a printing operation), it is judged that the printing paper 2 is erroneously drawn into the winding path 15, and thus the jam due to the printing paper 2 can be detected.

Figure 6:
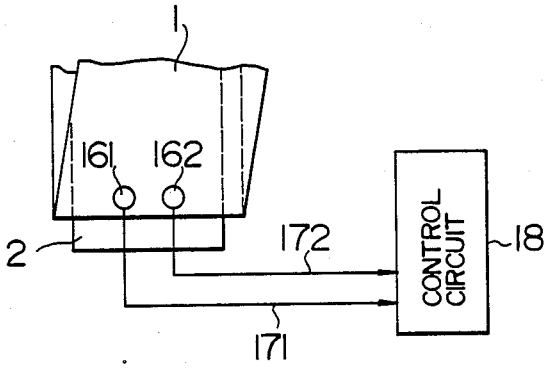
FIG. 6 is a circuit diagram showing a modified version of the further example of FIGS. 4 and 5.

FIG. 6 shows a modified version of the example of FIG. 4. Referring to FIG. 6, two photo-couplers 161 and 162 are made different in detection sensitivity from each other by mounting an optical filter on one of the photo-couplers, or by operating these photo-couplers in different operating conditions. In more detail, the photo-coupler 161 is put in an OFF-state when no body is transported to that portion of the transporting path 11 which is formed between the drum 9 and the guide member 101 and is put in an ON-state when the ink donor sheet 1 or printing paper 2 is transported to the above portion of the transporting path 11. While, the photo-coupler 162 is put in an OFF-state when any body is not transported or the ink donor sheet 1 is transported to the above-mentioned portion of the transporting path 11, and is put in an ON-state when only the printing paper 2 is transported. Respective output signals 171 and 172 of the photo-couplers 161 and 162 are applied to a control circuit 18. When both of the output signals 171 and 172 indicate the OFF-state, no body is transported to the above-mentioned portion of the transporting path 11. When both of the output signals 171 and 172 indicate the ON-state, only the printing paper 2 is transported. When the output signal 171 indicates the ON-state and the output signal 172 indicates the OFF-state, it is known that the ink donor sheet 1 is drawn into the above-mentioned portion of the transporting path 11.

The present example is required to include two photo-couplers. However, the output signals 171 and 172 of the photo-couplers 161 and 162 are applied directly to the control circuit 18 without passing through an intervening circuit, and hence the present example is inexpensive. Further, when the output signal 171 indicates the OFF-state and the output signal 172 indicates the ON-state, it is known that a fault has occurred in at least one of the photo-couplers 161 and 162.

Further, according to the present example, even when the ink donor sheet 1 is a polychromatic one containing yellow, magenta, cyan, black and others, a state that the ink donor sheet 1 is drawn into the above-mentioned portion of the transporting path 11, can be detected by increasing the number of photo-couplers in accordance with the number of colors used on the ink donor sheet 1.

When the ink donor sheet 1 is drawn into that portion of the transporting path 11 which is formed between the drum 9 and the guide member 101, the rotational direction of the winding reel 6 is reversed, or the rotating speed thereof is decreased. Hence, by detecting the rotational direction or rotating speed of the winding reel 7, it can be detected that the ink donor sheet 1 is drawn into the above-mentioned portion of the transporting path.

Figure 7:
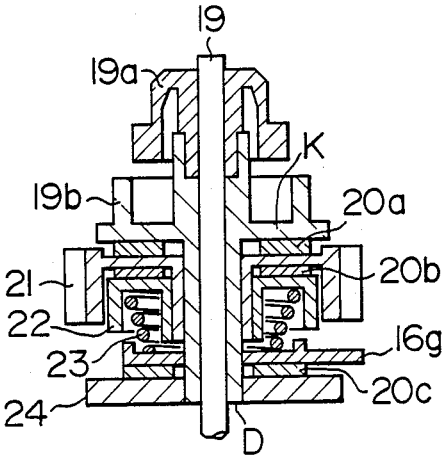
FIG. 7 is a sectional view showing a main part of a different example of the jam detecting means.

FIG. 7 shows a main part of a different example of the jam detecting means, that is, a mechanism for checking the rotation of the winding reel 7.

Referring to FIG. 7, an interlocking member **19*a* and a receiving member 19*b* are mounted on a driving shaft 19 by the press fit method, and the receiving member 19*b* is made up of a disk portion K which is extended perpendicularly to the driving shaft 19, and a long barrel portion D. Further, a driving gear 21 is mounted coaxially on the barrel portion D with a predetermined clearance therebetween. A cap member 22 and a compression spring 23 press the driving gear 21 against the disk portion K of the receiving member 19*b* through sliding members 20*a* and 20*b*. The compression spring 23 is held by a spring holding member 24 through a rotating switch member 16*g* and a sliding member 20*c*. The spring holding plate 24 is mounted on the barrel portion D of the receiving member 19*b* by the press fit method. The driving gear 21, the receiving member 19*b* and the sliding member 20*a*** make up the sliding clutch.

Figure 8:
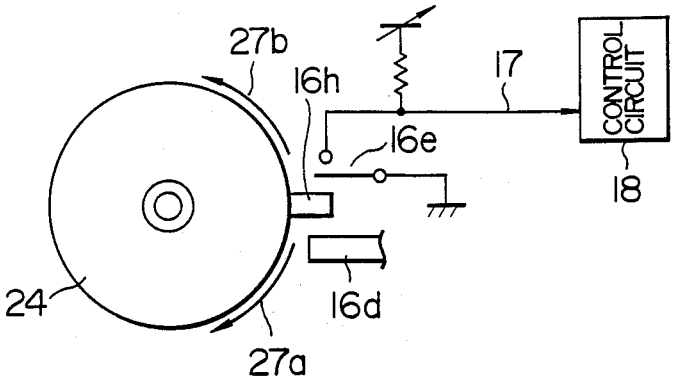
FIG. 8 is a side view showing the different example of FIG. 7.

When the main shaft 8 is driven, the driving gear 21 is rotated in a direction **27*a* shown in FIG. 8, with the aid of the power transmission means (not shown), and thus a driving force is transmitted from the gear 21 to the receiving member 19*b* through the sliding member 20*a*. As mentioned above, the sliding clutch is made up of the gear 21, the sliding member 20*a* and the receiving member 19*b*. Accordingly, when the driving force supplied from the gear 21 becomes greater than the frictional force between the receiving member 19*b* and the sliding member 20*a*, the receiving member 19*b*** begins to rotate.

The interlocking member **19*a* is mounted on the driving shaft 19 by the press fit method, and is inserted into the winding reel 7. Thus, when the driving gear 21 is rotated, the winding reel 7** is also rotated.

The rotating switch member **16*g* has a protruding portion 16*h*. As shown in FIG. 8, the rotation of the switch member 16*g* is limited by a stop member 16*d* and a switch 16*e***.

In a case where the winding reel 7 is rotated in the direction **27*a* to roll the ink donor sheet 1 round the reel 7, the rotating switch member 16*g* is rotated by the driving force supplied from the gear 21, and the rotation of the switch member 16*g* is stopped when the protruding member 16*h* reaches the stopper 16*d*. While, in a case where the ink donor sheet 1 is drawn into that portion of the transporting path 11 which is formed between the drum 9 and the guide member 101, and thus the rotational direction of the winding reel 7 is reversed, the switch member 16*g* is rotated in a direction 27*b* in accordance with the rotation of the spring holding plate 24, and the protruding member 16*h* pushes the movable member of a switch 16*e*, that is, the switch 16*e* is turned on. Thus, a signal 17 is sent to a control part 18, and the jam due to the ink donor sheet 1** can be detected.

Next, explanation will be made of still another example of the jam detecting means, in which example the rotational state of a reflecting plate rotating together with the winding reel 7 is detected by a photo-sensor to find the reversal of the rotational direction of the winding reel or a decrease in rotating speed thereof, thereby detecting that the ink donor sheet 1 has been drawn into the above-mentioned portion of the transporting path 11.

Figure 9:
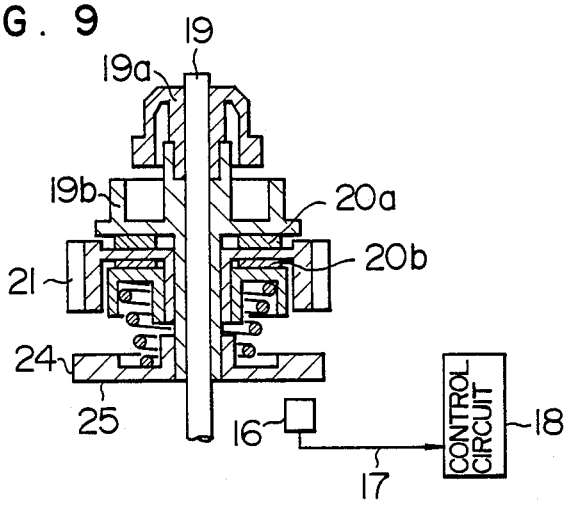
FIG. 9 is a sectional view showing a main part of still another example of the jam detecting means.
Figure 10:
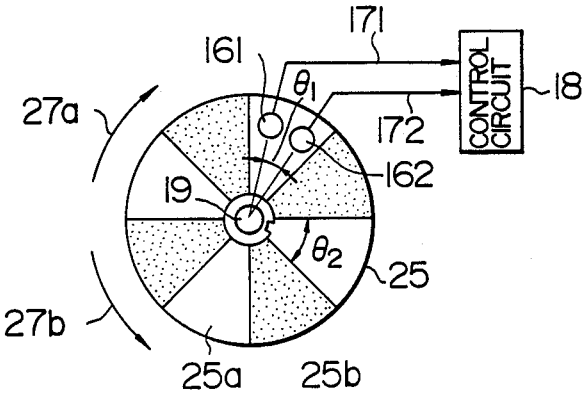
FIG. 10 is a front view showing the reflecting plate 25 of FIG. 9.

FIG. 9 shows the above example, in which a reflecting plate 25 is mounted on the spring holding plate 24, and the rotational state of the reflecting plate 25 is detected by a photo-sensor, and FIG. 10 is a front view of the reflecting plate 25.

Referring to FIG. 10, the reflecting plate 25 is divided into an even number of equal sectors around the driving shaft 19, and a reflecting sector (namely, reflecting portion) **25*a* for reflecting incident light and a non-reflecting sector (namely, a non-reflecting portion) 25*b* for absorbing incident light are alternately arranged. Two photo-sensors, for example, two photo-couplers 161 and 162 are disposed so as to face the reflecting plate 25. Further, each of the photo-couplers 161 and 162 is put in an ON-state when the photo-coupler faces the reflecting portion 25*a*, and is put an OFF-state when the photo-coupler faces the non-reflecting portion 25*b*. The angle $\theta_1$ between a radial direction passing through the photo-coupler 161 and another radial direction passing through the photo-coupler 162, is made smaller than the apex angle $\theta_2$ of each of the sectors 25*a* and 25*b*, in order for the photo-couplers 161 and 162** to detect the same reflecting or non-reflecting portion for a desired period.

Next, the operation of the present example will be explained below.

When a driving force is transmitted to the driving gear 21, a constant driving force is supplied from the gear 21 to the receiving member **19*b* through the sliding member 20*a*. Thus, the driving shaft 19, the spring holding plate 24 and the winding reel 7 are rotated as one body. However, when the ink donor sheet 1 is not separated from the printing paper but is drawn into that portion of the transporting path 11 which is formed between the drum 9 and the guide member 101, the rotational direction of the winding reel 7 and the reflecting plate 25** is reversed.

Figure 11:
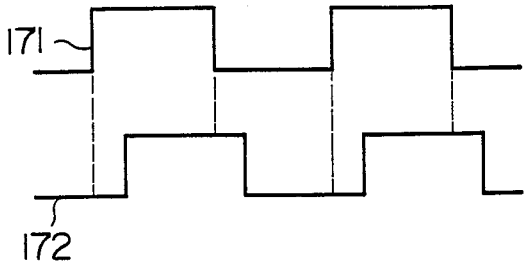
FIGS. 11 and 12 are timing charts showing phase relations between output signals from photodetectors of FIG. 10.

FIG. 11 is a timing chart showing the output signals 171 and 172 of the photo-couplers 161 and 162 in a case where the driving shaft 19 is rotated in a direction 27*a* shown in FIG. 10 to roll the ink donor sheet 1 round the mounting reel 7. As shown in FIG. 11, the output signal 171 takes a high or low level earlier than the output signal 172, that is, the output signal 171 leads the output signal 172 by a constant phase angle.

Figure 12:
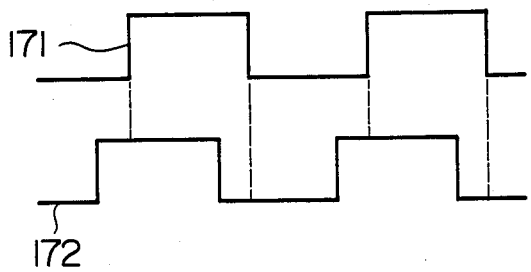

FIG. 12 is a timing chart showing the output signals 171 and 172 in a case where the rotational direction of the driving shaft 19 has been reversed and thus the driving shaft 19 is rotated in a direction 27*b* shown in FIG. 10 so that the ink donor sheet 1 is drawn out from the winding reel 7. As shown in FIG. 12, the output signal 172 leads the output signal 171 by a constant phase angle.

The rotational direction 27*a* or 27*b* of the driving shaft 19 can be detected by checking the phase relation between the output signals 171 and 172 by a control circuit 18, and thus the jam due to the ink donor sheet 1 can be detected. Further, a speed, at which the ink donor sheet 1 is rolled round the mounting reel 7, can be detected by detecting the pulse repetition period of the output signal 171 or 172 at the control circuit 18. Furthermore, variations in the above speed can be detected by detecting variations in pulse repetition period of the output signal 171 or 172.

In the present example, the reflecting plate 25 and two photo-sensors are used for detecting the rotational state of the winding reel 7. However, the rotational state of the reel 7 may be detected by a magnetic method. That is, a magnetic plate where an S-pole and an N-pole are alternately arranged, is used in place of the reflecting plate 25, and two magnetic sensors (for example, Hall elements or magneto resistive elements) each capable of discriminating between two magnetic states are used in place of the photo-sensors 171 and 172. The combination of the magnetic plate and magnetic sensors can detect the rotational state of the winding reel 7 in the same manner as the combination of the reflecting plate and photo-sensors.

Next, a case where the reflecting plate 25 having a reflecting pattern different from that shown in FIG. 10 is used, will be explained, with reference to FIGS. 13 and 14.

Figure 13:
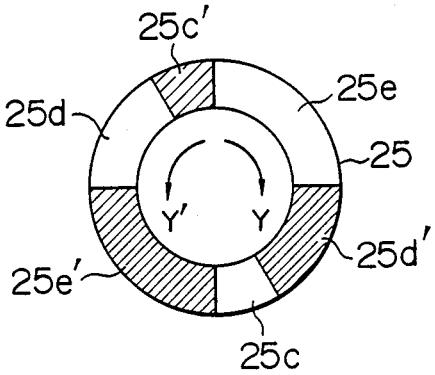
FIG. 13 is a front view showing a modified version of the reflecting plate shown in FIG. 10.
Figure 14:
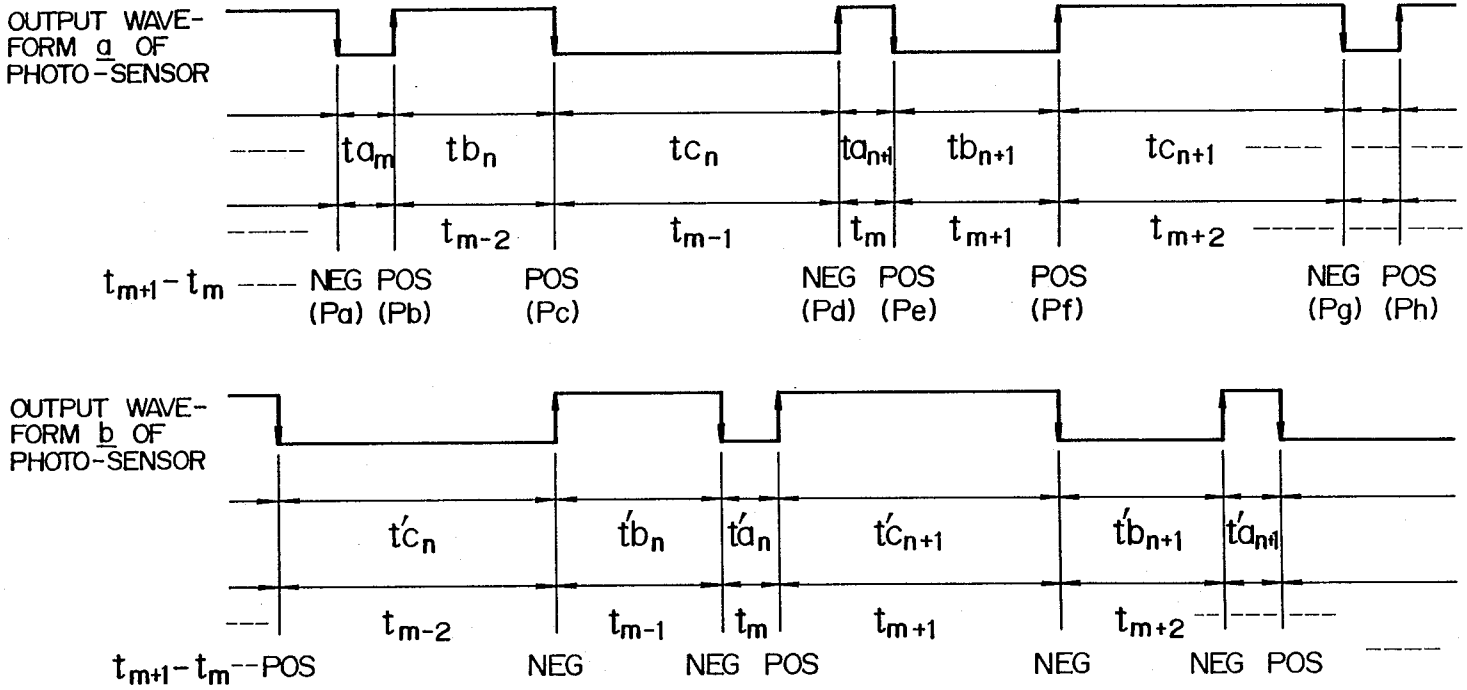
FIG. 14 is a timing chart showing two kinds of output waveforms of a photo-sensor which receives light reflected from the reflecting plate of FIG. 13, and showing features extracted from the output waveforms.

FIG. 13 is a front view showing a reflecting plate 25 which is fixed to the winding reel 7 or the spring holding plate 24, to rotate together with the winding reel 7.

Referring to FIG. 13, the reflecting plate 25 is divided in reflecting portions 25*c*, 25*d* and 25*e* and non-reflecting portions 25*c*', 25*d*' and 25*e*'. In the present case, in order to detect the rotational direction of the reflecting plate 25 by a single photo-sensor 16*f*, the length of the reflecting portion 25*c* and the non-reflecting portion 25*c*' in a circumferential direction of the reflecting plate 25 is made smallest, the length of the portions 25*e* and 25*e*' in the circumferential direction is made largest, and the length of the portions 25*d* and 25*d*' in the circumferential direction is made intermediate between the length of the portions 25*c* and 25*c*' and that of the portions 25*e* and 25*e*'. The reflecting portions 25*c*, 25*d* and 25*e* and the non-reflecting portions 25*c*', 25*d*' and 25*e*' are arranged as shown in FIG. 14. When the ink donor sheet 1 is normally rolled round the winding reel 7, the reflecting plate 25 is rotated in a Y-direction. When the jam due to the ink donor sheet 1 occurs, the reflecting plate 25 is rotated in a Y'-direction.

A photo-sensor 16*f* is disposed in front of the reflecting plate 25. When the photo-sensor 16*f* faces each of the reflecting portions 25*c*, 25*d* and 25*e*, the output signal of the photo-sensor takes a high level. When the photo-sensor 16*f* faces each of the non-reflecting portions 25*c*', 25*d*' and 25*e*', the output signal of the photo-sensor takes a low level. FIG. 14 shows a waveform a of the output signal obtained when the reflecting plate 25 is rotated in the Y-direction, and a waveform b of the output signal obtained when the reflecting plate 25 is rotated in the Y'-direction.

Now, let us judge the rotational direction of the reflecting plate 25 on the basis of variations in time interval between adjacent edges of the output signal. When a time necessary for the small portions 25*c* and 25*c*' to pass through the front of the photo-sensor 16*f*, a time necessary for the intermediate portions 25*d* and 25*d*' to pass through the front of the photo-sensor and a time necessary for the large portions 25*e* and 25*e*' to pass through the front of the photo-sensor are expressed by ta, tb and tc, respectively, we can obtain the following formula:

$$t_a < t_b < t_c.$$

The time interval between adjacent edges of the output signal of the photo-sensor varies as indicated by the following sequence:

$$\ldots \; t_{an-1} - t_{bn-1} - t_{cn-1} - t_{an} - t_{bn} - t_{cn-} - t_{an+1} - t_{bn+1} - t_{cn+1}$$

Now, let us pay attention to only a time $t_a$ necessary for the reflecting portion 25*c* to pass through the front of the photo-sensor, by way of example. The rotational speed of the winding reel 7 at a time the ink donor sheet 1 begins to be rolled round the reel 7 is made different from the rotational speed of the reel at a time the greater part of the ink donor sheet 1 has been rolled round the reel 7, and thus the time $t_a$ is not constant. Accordingly, when the time intervals $t_a$, $t_b$ and $t_c$ are used as they are, there is a fear of performing a malfunction. However, a time interval $t_{an}$ and the next time interval $t_{an+1}$ with respect to the reflecting portion 25*c* are nearly equal to each other. Accordingly, in the present case, the difference between adjacent time intervals is used for detecting the rotational direction of the reflecting plate 25.

Now let us express a time interval between a first edge of the output signal of the photo-sensor 16*f* and a second edge adjacent to the first edge and a time interval between the second edge and a third edge adjacent to the second edge by $t_m$ and $t_{m+1}$, respectively, and judge the sign of a difference $(t_{m+l} - t_m)$. Further, let us carry out the above processing at every edge of the output signal. Then, in a case where the winding reel 7 is rotated in the Y-direction, the sign of the difference between adjacent time intervals varies in the order of . . . positive-positive-negative-positive-positive-negative . . . , as shown under the waveform a of FIG. 14. In a case where the winding reel 7 is rotated in the Y'-direction, the sign of the difference between adjacent time intervals varies in the order of . . . negative-negative-positive-negative-negative-positive . . . , as shown under the waveform b of FIG. 14. Further, when the winding reel 7 is stopped, the output signal of the photo-sensor 16*f* is kept constant. In FIG. 14, for example, the term "pos" at a time $P_c$ indicates that the result obtained by subtracting the time interval $t_{m-2}$ just before the time $P_c$ from the time interval $t_{m-1}$ just after the time $P_c$ is positive, and the term "neg" at the time $P_d$ indicates that the result obtained by subtracting the time interval $t_{m-1}$ just before the time $P_d$ from the time interval $t_m$ just after the time $P_d$ is negative.

Figure 15:
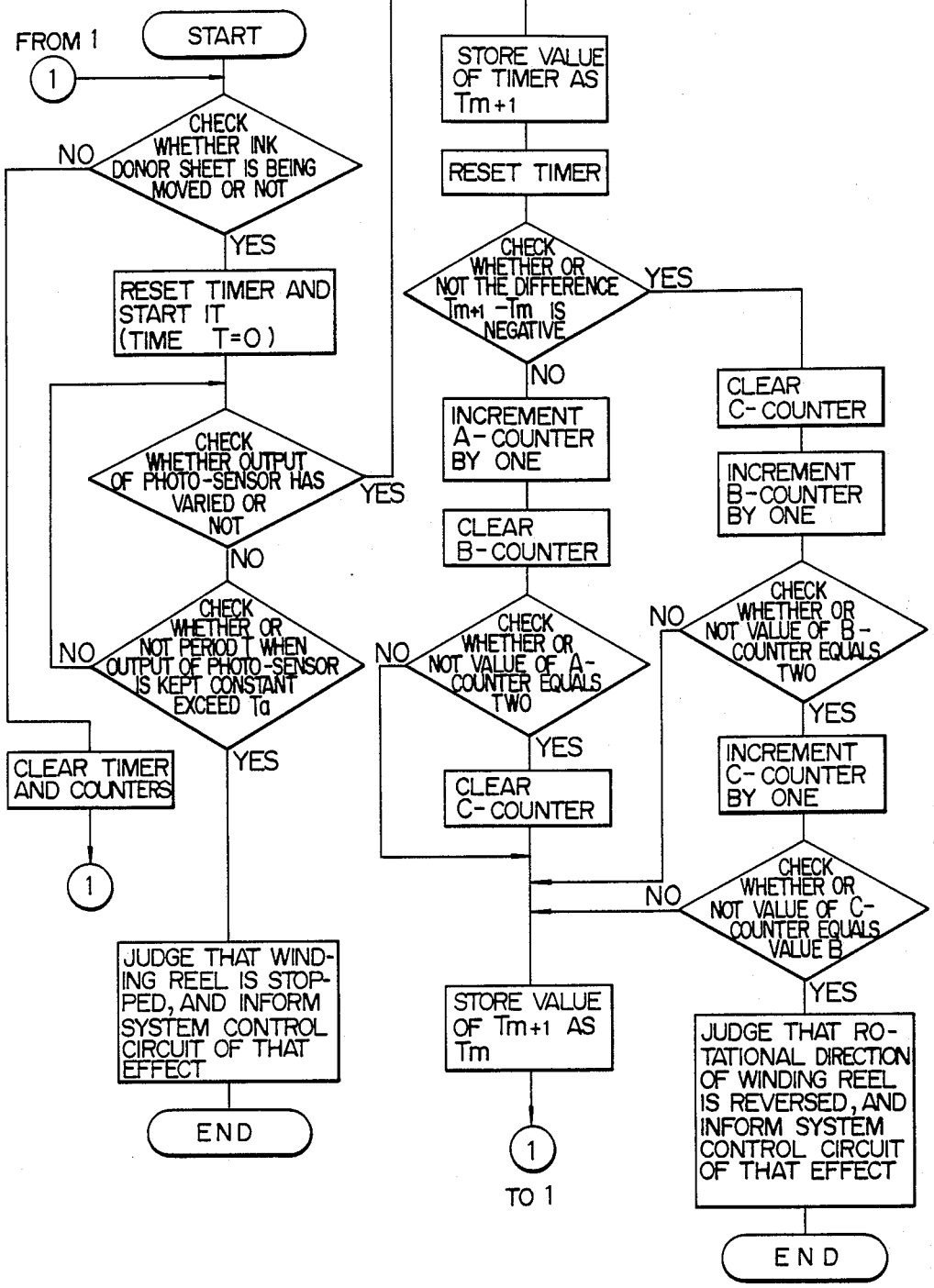
FIG. 15 is a flow chart for explaining a method of detecting the rotational direction of the reflecting plate of FIG. 13.

FIG. 15 is a flow chart showing the processing for detecting the rotational direction of the winding reel 7 on the basis of the above facts. The processing shown in the flow chart of FIG. 15 is carried out by the control circuit 18 of FIG. 9. Referring to FIG. 15, when a signal from a system control circuit informs the control circuit 18 that the thermal head 3 is pressed against the drum 9, a driving motor is operated, and the ink donor sheet 1 is being moved, the control circuit 18 resets a timer included therein and causes the timer to start a counting operation. In a case where the output signal of the photo-sensor 16*f* is kept constant for a predetermined time $T_a$, the control circuit 18 judges that the winding reel 7 is stopped, and informs the system control circuit of that effect, to stop the whole system.

In a case where the output signal of the photosensor 16*f* varies in the predetermined time $T_a$, the output of the timer at a time the output signal is varied, is memorized in a memory, to be used as $t_{m+l}$, and the timer is again reset. Next, the difference $(t_{m+l}-t_m)$ is calculated, and A-, B- and C-counters included in the control circuit 18 are incremented or reset in accordance with the signal of the above difference. Thereafter, the value of $t_{m+l}$ is stored in the memory, to be used as $t_m$, and the above processing is again carried out.

Now, explanation will be made of the operation of each of the A-, B- and C-counters and a method of determining the rotational direction of the winding reel 7, with reference to FIG. 16.

Figure 16:
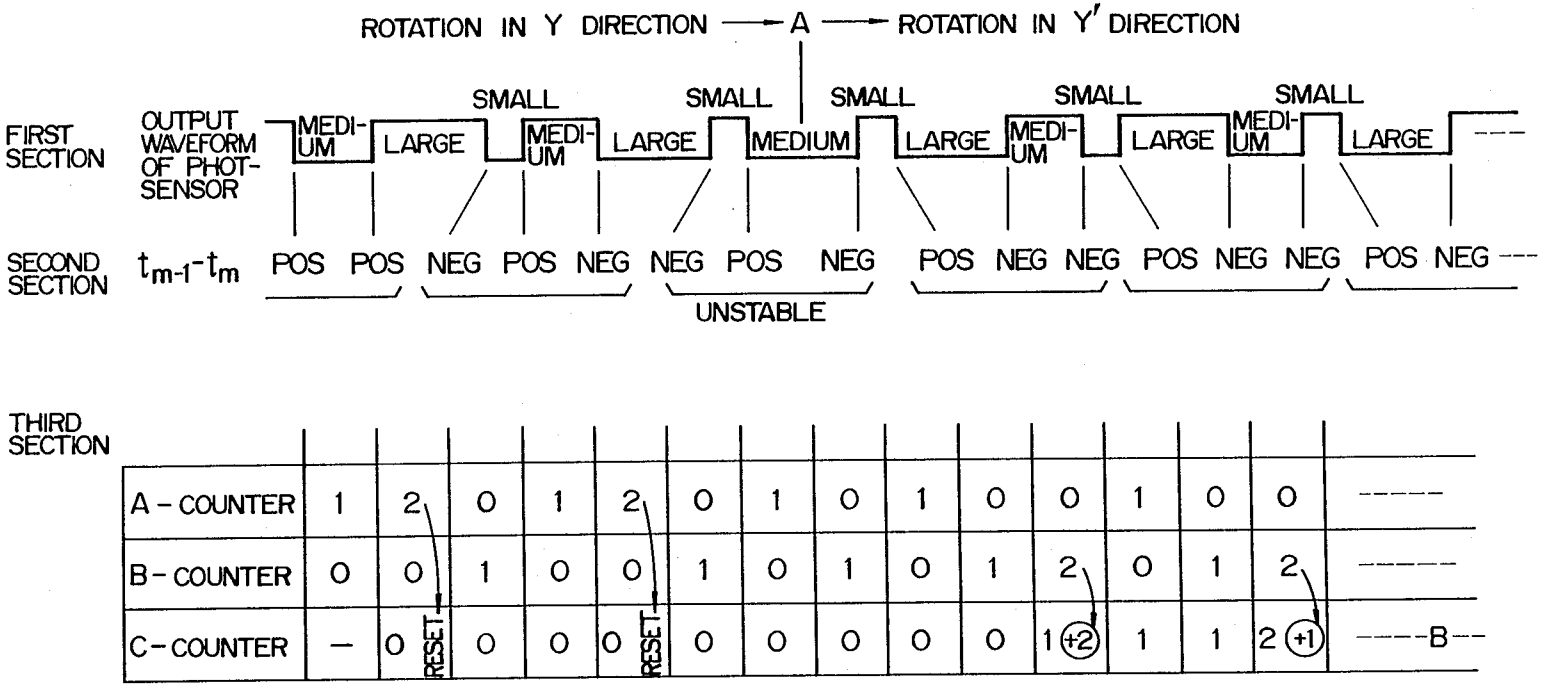
FIG. 16 is a diagram showing the output waveform of the photo-sensor which receives light reflected from the reflecting plate of FIG. 13, features extracted from the above output waveform, and output values of A-, B- and C-counters.

The first section of FIG. 16 shows the change of the output signal of the photo-sensor 16*f* in a case where the winding reel 7 is rotated in the Y-direction till a time A and is then rotated in the Y'-direction. The second section of FIG. 16 shows the sign of the result obtained by subtracting the time interval $t_m$ from the time interval $t_{m+l}$.

The A-timer is incremented by one when the difference $t_{m+l}-t_m$ is positive, and is reset when the above difference is negative. The B-counter is incremented by one when the difference $t_{m+l}-t_m$ is negative, and is reset when the above difference is positive. The C-counter is reset each time the value of the A-counter reaches 2 (two), and is incremented by one each time the value of the B-counter reached 2 (two). The third section of FIG. 16 shows the values of the A-, B- and C-counters corresponding to the sequence of the sign of the difference $(t_{m+l}-t_m)$ shown in the second section of FIG. 16.

The A-, B- and C-counters are operated in the above-mentioned manner, to determine the rotational direction of the winding reel 7 on the basis of the value of the C-counter.

In a case where the winding reel 7 is rotated in the Y-direction, the sign of the difference $(t_{m+l}-t_m)$ varies in such a manner that a pattern (negative-positive-positive) is repeated. When the positive sign appears twice in a continuous manner, the value of the A-counter reaches 2 (two), and thus the C-counter is reset. In other words, in the case where the winding reel 7 is rotated in the Y-direction, the value of the C-counter is made equal to zero. While, in a case where the winding reel 7 is rotated in the Y'-direction, the sign of the difference $(t_{m+l}-t_m)$ varies in such a manner that a pattern (positive-negative-negative) is repeated. When the negative sign appears twice in a continuous manner, the value of the B-counter reaches 2 (two), and thus the C-counter is incremented by one. That is, the C-counter is incremented by one each time the pattern (positive-negative-negative) caused by the rotation of the winding reel 7 in the Y'-direction is detected. When the value of the C-counter reaches 1 (one) or a value B greater than one, the control circuit 18 judges that the winding reel 7 is rotated in a direction opposite to a normal direction, and informs the system control circuit of that effect, to stop the system. In the present example, in order to prevent a malfunction at the beginning of a printing operation, a malfunction before the time interval $t_m$ is determined, and other malfunctions, the value B is made equal to two.

According to the above method, the rotational direction of the winding reel 7 can be detected by using only a single photo-sensor (namely, the photo-sensor 16*f*), without being disturbed by a malfunction, and thus the jam due to the ink donor sheet 1 can be rapidly detected.

In the present example, the reflecting plate 25 is fixed directly to the winding reel 7, or fixed to the spring holding plate 24, to detect the rotation of the winding reel 7 in a wrong direction. However, it is also possible to detect the movement of the ink donor sheet 1 in the wrong direction directly, as mentioned below.

Figure 17:
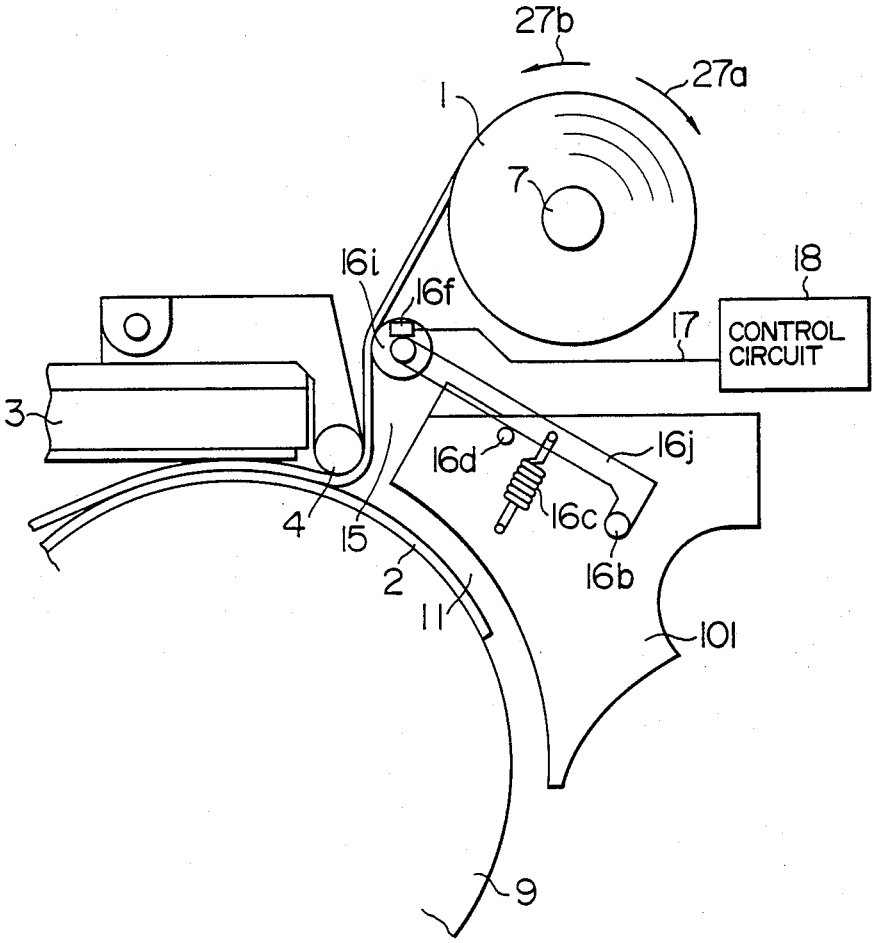
FIG. 17 is a side view showing still a further example of the jam detecting means.

FIG. 17 shows still a further example of the jam detecting means. Referring to FIG. 17, the present example is made up of a supporting member 16*j*, one end of which is held rotatably by a shaft 16*b*, a rotating member 16*i* mounted rotatably on the other end of the supporting member 16*j* and disposed in the winding path 15 while being kept in contact with the ink donor sheet 1, detection means 16*f* (or 161 and 162) for detecting the rotational direction of the rotating member 16*i*, and others. An output signal 17 from the detection means is applied to the control circuit 18. The reflecting plate 25 shown in FIGS. 10 or 13 is mounted on the rotating member 16*i*, to detect the rotational direction of the rotating member 16*i*, thereby detecting the moving direction of the ink donor sheet 1.

In a case where the ink donor sheet 1 is moved in a winding direction 27*a*, a first output waveform indicating this state is supplied from the detection means to the control circuit 18. In a case where the ink donor sheet 1 is drawn in that portion of the transporting path 11 which is formed between the drum 9 and the guide member 101, the ink donor sheet 1 is moved in a direction 27*b* opposite to the above moving direction 27*a*, and a second output waveform indicating this state is applied to the control circuit 18. That is, the jam due to the ink donor sheet 1 can be detected by the second output waveform.

According to the present example, even in a case where a force for rolling the ink donor sheet 1 round the winding reel 7 is weak and thus the ink donor sheet 1 is rolled loosely round the reel 7, the jam due to the ink donor sheet 1 can be surely detected, since the moving direction of the ink donor sheet 1 is directly detected.

As has been explained in the foregoing, according to the present invention, it can be readily detected that the ink donor sheet 1 is drawn into a predetermined portion of the printing-paper transporting path. Accordingly, the jam due to the ink donor sheet 1 or printing paper 2 in a printer or others can be early and surely detected, and the printer or others can be immediately stopped.

Further, jam detecting means according to the present invention is simple is structure, and hence a design work for mounting the above jam detecting means on a conventional thermal ink-transfer printer is not difficult.

We claim:

1. A thermal ink-transfer printer having a jam detecting capability, comprising:

a rotating drum for carrying printing paper by a cylindrical surface of the rotating drum;

guide means disposed to form a predetermined clearance between said cylindrical surface of said rotating drum and said guide means, said guide means having a printing-paper inlet and an insertion portion into which a printing head is insertable;

ink donor sheet supply means made up of a supply reel and a winding reel, an ink donor sheet wound on said supply reel being supplied to said winding reel in such a manner that said ink donor sheet is rolled around said winding reel, said ink donor sheet when drawn out from said supply reel being adapted for contact with printing paper carried in accordance with the rotation of said drum at said portion of said guide means into which a printing head is insertable;

a thermal head disposed in the neighborhood of said insertion portion of said guide means whereby ink on said ink donor sheet may be transferred to said printing paper by heat generated in said thermal head;

a separation member disposed between said thermal head and a downstream end of said insertion portion of said guide means for separating said ink donor sheet after completing ink transfer from said printing paper, said ink donor sheet after separation from said printing paper being rolled around said winding reel, said printing paper after separation from said ink donor sheet being introduced from the end of said head insertion portion of said guide means into a printing-paper transporting path, said path being formed between said guide means and the cylindrical surface of said drum; and jam detecting means responsive to reversal of a transportation direction of the ink donor sheet for generating a signal when said ink donor sheet, after having completed the ink transfer, is drawn into that portion of said printing-paper transporting path which exists in the neighborhood of the end of said head insertion portion of said guide means.

2. A thermal ink-transfer printer according to claim 1, wherein said jam detecting means is provided at the end of said head insertion portion of said guide means and further includes a switch provided at an inlet portion of said printing-paper transporting path at the head insertion portion and controlled by a detection member, and said detection member is adapted to be pushed by said ink donor sheet when said ink donor sheet after having completed the ink transfer is drawn into said portion of said printing-paper transporting path.

3. A thermal ink-transfer printer according to claim 1, wherein said jam detecting means further includes a switch controlled by a detection member, and said detection member is pushed by said ink donor sheet when said ink donor sheet having completed the ink transfer is normally rolled round said winding reel without being drawn into said portion of said printing-paper transporting path.

4. A thermal ink-transfer printer according to claim 1, wherein said jam detecting means includes a photo-sensor for generating a signal when said ink donor sheet after having completed think transfer is drawn into said portion of said printing-paper transporting path, and wherein said jam detecting means is effective to detect when the ink donor sheet is first drawn into the printing-paper transporting path following the position of said separation member and further includes means for detecting reversal of rotation of said winding reel comprising a reflecting plate which is rotated together with said winding reel and is disposed so as to confront said photo-sensor.

5. A thermal ink-transfer printer according to claim 4, wherein said reflecting plate has reflecting portions and non-reflecting portions which are arranged so that the reflecting portion and the non-reflecting portion are alternately disposed on said reflecting plate.

6. A thermal ink-transfer printer according to claim 4, wherein said reflecting plate has a plurality of reflecting portions and a plurality of non-reflecting portions which are arranged so that the reflecting portion and the non-reflecting portion are alternately disposed on said reflecting plate, and reflecting and non-reflecting portions having the same width in a circumferential direction of said reflecting plate are symmetrical with respect to the rotation axis of said reflecting plate.

7. Thermal ink-transfer printer according to claim 6, wherein said reflecting portions of said reflecting plate are different from one another in the width in a circumferential direction of said reflecting plate.

8. A thermal ink-transfer printer according to claim 1, wherein said jam detecting means includes a photo-sensor for generating a signal when said ink donor sheet after having completed the ink transfer is drawn into said portion of said printing-paper transporting path, and wherein said jam detecting means further includes means for detecting reversal of the movement direction of said ink donor sheet comprising a reflecting plate which is rotated in accordance with the movement of said ink donor sheet and is disposed so as to confront said photo-sensor.

9. A thermal ink-transfer printer according to claim 8, wherein said reflecting plate has reflecting portions and non-reflecting portions which are arranged so that the reflecting portion and the non-reflecting portion are alternately disposed on said reflecting plate.

10. A thermal ink-transfer printer according to claim 8, wherein said reflecting plate has a plurality of reflecting portions and a plurality of non-reflecting portions which are arranged so that the reflecting portion and the non-reflecting portion are alternately disposed on said reflecting plate, and reflecting and non-reflecting portions having the same width in a circumferential direction of said reflecting plate are symmetrical with respect to the rotation axis of said reflecting plate.

11. A thermal ink-transfer printer according to claim 10, wherein said reflecting portions of said reflecting plate are different from one another in the width in a circumferential direction of said reflecting plate.

12. A thermal ink-transfer printer according to claim 1, wherein said jam detecting means includes a rotation sensor for detecting the reversal of rotation of said winding reel.

* * * * *